United States Patent [19]

Carter et al.

[11] Patent Number: 5,041,941

[45] Date of Patent: Aug. 20, 1991

[54] CHARGE CONTROL FOR EB COATED PAPERBOARD

[75] Inventors: R. Douglas Carter, Columbia, Md.; David W. Paxton, Newark, Del.; William H. Plummer, Jr., Columbia, Md.

[73] Assignee: Westvaco Corporation, New York, N.Y.

[21] Appl. No.: 446,797

[22] Filed: Dec. 6, 1989

[51] Int. Cl.[5] ..... H05F 3/00

[52] U.S. Cl. ..... 361/225; 361/214

[58] Field of Search ..... 361/212, 214–220, 361/225

[56] References Cited

U.S. PATENT DOCUMENTS

| | | | |
|---|---|---|---|
| 2,483,542 | 10/1949 | Hooper | 361/213 |
| 3,670,203 | 6/1972 | Whitmore, Jr. et al. | 361/225 |
| 3,671,806 | 6/1972 | Whitmore et al. | 361/212 |
| 3,717,791 | 2/1973 | Heyl et al. | 361/212 |
| 3,787,706 | 1/1974 | De Geest | 361/212 |
| 4,363,070 | 12/1982 | Kisler | 361/212 |
| 4,513,683 | 4/1985 | Kisler | 361/221 |

*Primary Examiner*—A. D. Pellinen
*Assistant Examiner*—Jeffrey A. Gaffin

[57] ABSTRACT

An apparatus and method for removing an accumulated charge or for applying a predetermined electrifcal charge to a web of polymer coated paperboard that is printed with electron beam (EB) cured inks. During the EB printing process, the polymer coated surface may accumulate a charge in excess of 500 volts as a result of the EB irradiation. The accumulated charge may be removed by passing the web through a charging zone where a voltage is applied to the web having the same polarity as the charge on the web. A control system for measuring the charge on the web received by the EB irradiation and for adjusting the extent and sign of the voltage applied to the web for placing a predetermined electrical charge condition on the web is included.

8 Claims, 1 Drawing Sheet

CHARGE CONTROL FOR EB COATED PAPERBOARD

BACKGROUND OF INVENTION

The present invention relates generally to a converting process and more particularly to a method for controlling the surface charge on a printed substrate used in a converting process. Specifically, the invention is disclosed with respect to polymer coated substrates printed with EB (electron beam) cured inks. The printed surface may either be an uncoated or clay coated surface.

The high speed of polymerization offered by electron beam curing provides a new tool for the manufacture of unique products. For example, a wet electron beam cured coating, which is typically applied from a roll surface or from a gravure cylinder, has little time to soak into or penetrate the substrate prior to cure if the dwell time-to-viscosity relationship is well controlled. When energetic electrons from the electron beam are absorbed by the coating, they produce a polymerization reaction between the multifunctional monomer and the unsaturated prepolymer in the coating in a period of tens of milliseconds. Thus, a wet coating will be converted to a tack free film in a matter of only a few milliseconds after passing through the electron beam. This feature has led to a number of EB applications on paper, particularly printing processes. However surface charge problems have arisen in some cases where the EB printing is applied to paper or paperboard containing a polymer coating.

Charge accumulation in polymers due to EB irradiation is not new. These charges are caused by electrons becoming trapped in the polymer. For instance, in an EB printing operation on paperboard, the primary electrons impinge on the inked surface of the paperboard. However, this surface absorbs only about 40% of the electrons to effect curing. The remaining electrons penetrate the paperboard surface where they produce a large number of secondary electrons, caused by primary electrons ionizing molecules within the paperboard substrate. Some of these secondary electrons along with as many as 10% of the primary electrons can reach polymer coatings applied to the opposite surface of the paperboard substrate. These electrons become trapped in the polymer layer to produce an overall positive surface charge on the substrate. The amount of charge trapped depends in large part upon the type of polymer coating applied to the substrate and the moisture content of the paper or paperboard. Polyethylene terephthalate (PET) is twenty times more efficient at trapping a charge than polyethylene because of the presence of a large number of unsaturated bonds in the PET. Likewise, the lower the moisture content of the paper or paperboard, the greater the accumulated charge. In any event the accumulation of too great of a surface charge on the substrate plays havoc with subsequent converting operations using the substrate. Devices and methods for removing or applying an electrical charge to paper during converting processes are known as taught in U.S. Pat. Nos. 2,483,542 and 3,670,203. However, such devices have proven to be ineffective at removing the accumulated charge on polymer coated substrates. Accordingly, the present invention was developed to control the charge on a polymer coated paper or paperboard substrate subjected to EB irradiation by removing or adding a charge as desired.

SUMMARY OF INVENTION

An accumulated charge is acquired on the polymer coated surface of paperboard webs which are printed on the opposite surface with electron beam cured inks. This charge is positive and cannot be removed using standard static removal techniques. The accumulated charge makes subsequent converting steps using the printed paperboard difficult if not impossible.

The charge accumulation is a direct result of irradiation by the electron beam (EB). The magnitude of the accumulated charge decreases with increasing board moisture content. If the moisture content of the paperboard is greater than about 5–6% prior to the EB cure, the accumulated charge picked up by the polymer coated surface is not objectionable. The accumulated charge can also be removed by application of a polar liquid to the polymer coated surface followed by contact with a grounded electrode. Charge removal may also be accomplished by applying heat to the polymer coated surface with the use of a drier such as an IR impact drier. However, these techniques are not always 100% successful.

According to the present invention, a method has been developed for controlling the charge accumulated on the polymer coated surface of a paperboard web during EB irradiation. The method of the present invention uses an applied voltage as the driving force in combination with a wet grounded electrode in contact with the polymer coated surface of a paperboard web for reducing excessive accumulated charge on the polymer surface, or in some cases, for adding a desired charge to the web in response to varying conditions. The high voltage positive electrode must be mounted above the web and directly over the wet grounded electrode which is in contact with the web to affect the charge on the polymer surface. If the wet grounded electrode is allowed to dry out, no reduction in charge on the polymer surface is observed regardless of the voltage applied. Thus a wetting solution must be applied to the polymer coated surface in combination with an applied voltage to control the charge.

A voltmeter or other charge sensing device is mounted downstream of the charging electrode to provide continuous monitoring of the charge on the polymer surface after treatment. The voltmeter is connected to an automated charge controller which controls the voltage applied at the high voltage positive electrode to achieve a uniform charge on the polymer surface. With a designated set point programmed into the charge controller, it will increase or decrease the output of the power supply to the positive electrode in response to measurements made by the voltmeter to maintain the set point charge on the web.

Some net charge in the region of plus-or-minus 100 volts has been found to be desirable on the web to aid in later converting operations. In this case a negative charge on the web has the same effect as a positive charge in the converting operation. Specifically when the web is cut and scored to form carton blanks and cartons, carton stacking and packing are much easier to perform with a small net charge on the carton. This small net charge also helps hold the stacks of cartons together when they are being moved on a conveyor. Thus when printing polymer coated paperboard having a high moisture content, the paperboard may not accumulate any charge from the EB curing unit and a negative charge can be added for smooth operation. Conversely if the paperboard has a low moisture content, a large positive charge (up to about 500 volts) may be accumulated in the EB unit, thus necessitating the need to reduce the voltage on the web with the charging electrode.

According to the present invention, a method is disclosed for controlling the charge on a polymer coated paperboard substrate in an electron beam printing process. The automated charge control system for removing/adding a charge to the polymer coated surface of the paperboard uses a high voltage power supply, a wet grounded electrode, a PI controller and a monitor. The result is that the polymer coated paperboard web can be EB printed without producing problems during converting notwithstanding the moisture content of the web being printed.

DETAILED DESCRIPTION

Figure 1:
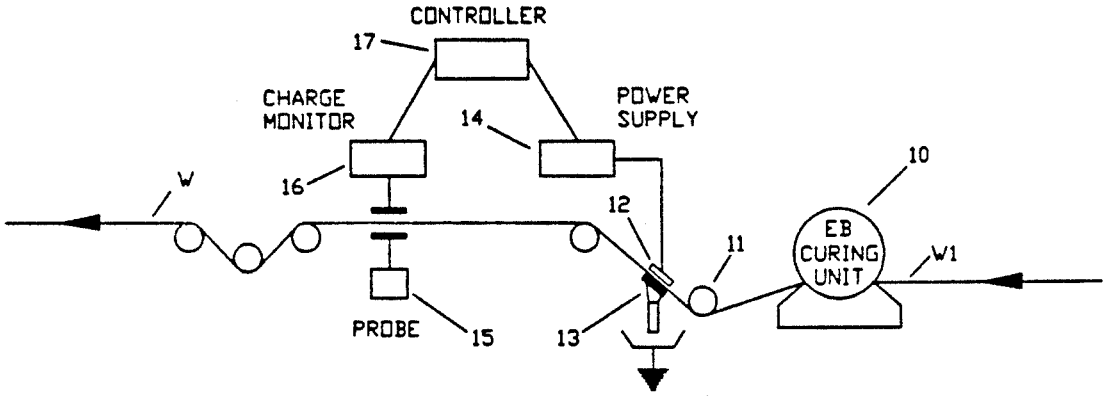
FIG. 1 is a schematic illustration showing the charge control system of the present invention applied to an EB cured printing and converting process; and, FIG. 2 is a schematic illustration of the charge control system of the present invention.

Referring to FIG. 1 of the drawings, a continuous web W of paperboard having one surface coated with a polymer coating is transported through and electron beam (EB) curing unit 10 where EB inks are applied to the opposite surface of the paperboard which are cured with EB irradiation. At the curing unit 10, the web W may acquire an accumulated positive net charge on the polymer surface making the web difficult to process in later converting operations. Thus, according to the present invention, after the web W passes through the EB curing unit 10, the web is transported through a charging station 11 comprising a high voltage positive electrode 12 positioned above and spaced from the web in non-contact relation, and a wet, grounded electrode 13 positioned below the web in line with the positive electrode 12 and in direct contact with the polymer coated surface of the web. The high voltage electrode 12 is connected to a high voltage power supply 14 for providing sufficient voltage to the charging electrode to develop a desired electrical charge condition on the web, i.e., neutral, or positively or negatively charged.

After passing through the charging station 11, the web W is transported past a charge sensor 15 which cooperates with a charge monitor 16 to measure the actual charge condition of the web. The charge monitor 16 and high voltage power supply 14 are connected to a charge controller 17. The charge controller compares the charge condition of the web W sensed by probe 15 with a pre-set condition and varies the power of the charge applied to the web W by high voltage positive electrode 12 to produce the desired electrical charge condition on the web.

The accumulated charge on the polymer coated web W does not respond to charge dissipation methods normally used to remove static charge. Thus, the present invention only functions with a wet grounded electrode 13. An example of such an electrode is a grounded wick coater in contact with the polymer coated surface of the web. The grounded wick coater preferably extends across the width of the web W for applying a wetting solution to the polymer coated surface of the web. The application of the wetting solution in combination with the driving force provided by the high voltage power supply provides the means for controlling the charge on the web. It will be understood that other coating devices such as roll, blade or blanket coaters may be used to apply the wetting solution to the polymer coated surface of the web.

The high voltage power supply 14 is preferably connected to a single positive bar electrode 12 arranged across the width of the web W. However, because the moisture of the web varies, charge differences as great as 300 volts across the web have been measured after treatment by the charge controller. Thus the web may be divided up into lanes for treatment. For this purpose, separate power supplies, high voltage electrodes and charge monitors are necessary for each lane to obtain maximum control of the charge applied. In one embodiment, four separately controlled positive bar electrodes are mounted in a staggered configuration across the web in combination with a dual wick coater to give full control of the charge across the web.

Figure 2:
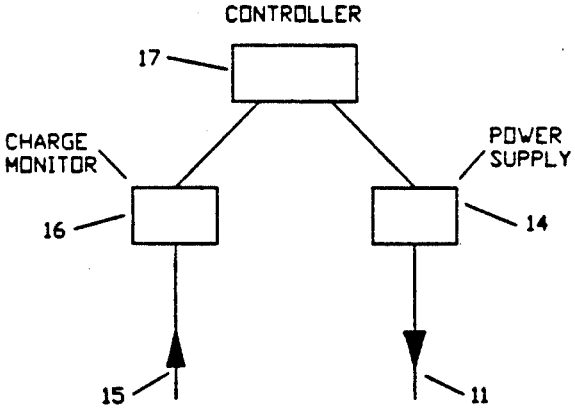

FIG. 2 shows schematically the electronics required to carryout the present invention. The charge controller 17 is a Fisher DPR 900 Controller used for example in conventional electronic control applications. Feedback to the controller 17 is provided by a Monroe Electronics Model 260 Charge Monitor 16 from voltages picked up by the charge sensing probe 15. A signal conditioner from Action Instruments Model 4320 is used to convert the output of the charge monitor 16 to a signal the charge controller 17 will accept. The charge controller 17 is pre-set to achieve a uniform electrical charge condition across the web. Thus, the charge controller compares the signal from the charge monitor 16 with its pre-set value, and adjusts the output voltage from the Hurletron high voltage power supply 14 through a suitable interface to provide the desired charge at the positive electrode 12 to achieve the desired electrical charge condition on the web.

To reduce the charge on the web or to reverse the polarity of the charge, the voltage applied should have the same sign as the charge on the web. To increase the charge on the web without changing its signs, the voltage applied should have the opposite sign. Any type of web material may be treated by the present invention but the invention is directed particularly to polymer coated webs which are printed by EB printing methods. Thus, while there has been disclosed herewith one principal embodiment of the present invention, it will be understood that it is capable of many modifications and changes within the spirit and scope of the appended claims.

What is claimed is:

1. In an electron beam printing press for printing on one surface of a moving web of paperboard containing a polymer coating no its opposite surface, means for controlling an electrical charge acquired by the polymer coated surface of the web as a result of electron beam irradiation comprising:

(a) a charging electrode located adjacent to the path of movement of the web and spaced from the upper printed surface thereof:

(b) a wet grounding electrode located adjacent to the path of movement of the web and in direct contact with the lower polymer coated surface thereof directly beneath the charging electrode;

(c) a high voltage power supply connected to the charging electrode for passing an electrode current through the web for creating a substantial and variable potential difference between said electrodes;

(d) monitoring means for measuring the charge on the moving web: and, (e) a control means connected between said monitoring means and said high voltage power supply for adjusting the potential difference applied between said electrodes for placing a predetermined electrical charge condition on said web.

2. The apparatus of claim 1 wherein the wet grounding electrode comprises a wick coater which extends across the width of the web.

3. The apparatus of claim 2 wherein the wick coater conducts a liquid to the polymer coated surface of the web.

4. A method for placing a predetermined electrical charge condition on a traveling web of paperboard which is coated on one surface with a polymer coating and printed on the opposite surface using electron beam irradiation comprising:

(a) transporting a polymer coated paperboard web through an electron beam curing station where the web picks up a positive charge on the polymer coated surface of the web;

(b) monitoring the electrical charge accumulated on the web as a result of the electron beam irradiation; and, (c) applying a voltage of a selected magnitude and polarity to the web at a charging station comprising a charging electrode spaced above and in non-contact relation with respect to the printed surface of the web and a wet grounded electrode positioned below and in contact with the polymer coated surface of the web directly beneath the charging electrode, for passing an electric current through the web to develop a predetermined charge condition on the web.

5. The method of claim 4 wherein a charge controller is connected between the charge monitoring device and the charging station for determining the magnitude and sign of the voltage applied to the web.

6. A method for placing a predetermined electrical charge condition on a traveling web of paperboard which is coated on one surface with a polymer coating comprising:

(a) transporting the web through a charging station comprising a charging electrode spaced above and in non-contact relation with the upper surface of the web and a wet grounded electrode located directly below the charging electrode, said wet grounded electrode being in direct contact with the polymer coated surface of the web;

(b) monitoring a electrical charge accumulated on the web; and, (c) applying a direct current volt of a prescribed magnitude and sign to the web to pass current the web at the charging station in response to the signal provided by a charge controller connected between the charging electrode and the monitoring device to place a predetermined charge condition on the web.

7. Apparatus for placing a predetermined electrical charge condition on a traveling web of paperboard having one surface coated with a polymer coating comprising, a charging station comprising a charging electrode spaced above and in non-contact relation with the upper surface of the web and a wet grounded electrode located directly below the charging electrode, said wet grounded electrode being in direct contact with the polymer coated surface of the web, a high voltage power supply connected to said charging electrode, a monitoring probe located downstream from the charging station for continuously measuring the electrical charge on the web, a charge monitor for receiving signals from said monitoring probe and a charge controller for comparing signals generated by the charge monitor with an internal pre-set condition to determine the magnitude and sign of the direct current voltage generated by the high voltage power supply for passing a current through the web to place a predetermined charge condition on the web.

8. Apparatus for removing the accumulated charge from a traveling web of paperboard, one surface of which is printed by electron beam irradiation, and the other surface of which is coated with a polymer coating, comprising a charging station consisting of a pair of electrodes, the first being a charging electrode positioned above and in non-contact relation with the printed surface of the traveling web and the second being a wet, grounded electrode in contact with the polymer coated surface of the web located directly below the charging electrode means for monitoring the electrical charge accumulated on the web, and means for generating a charging current between the electrodes and through the web of the same sign as the accumulated charge on the web to remove the accumulated charge from the web.

* * * * *